United States Patent [19]

May

[11] Patent Number: 4,648,689

[45] Date of Patent: Mar. 10, 1987

[54] PAVEMENT MARKING TAPE

[75] Inventor: David C. May, Stillwater, Minn.

[73] Assignee: Minnesota Mining and Manufacturing Company, St. Paul, Minn.

[21] Appl. No.: 730,431

[22] Filed: May 3, 1985

Related U.S. Application Data

[62] Division of Ser. No. 483,603, Apr. 11, 1983, Pat. No. 4,534,673.

[51] Int. Cl.[4] ..... G02B 5/12

[52] U.S. Cl. ..... 350/105; 404/14

[58] Field of Search ..... 350/105; 404/14, 15, 404/16

[56] References Cited

U.S. PATENT DOCUMENTS

| | | | |
|---|---|---|---|
| 3,418,896 | 12/1968 | Rideout | 404/14 |
| 3,877,786 | 4/1975 | Booras et al. | 350/105 |
| 3,994,086 | 11/1976 | Mizuochi | 350/105 |
| 4,035,059 | 7/1977 | DeMaster | 350/105 |
| 4,302,125 | 11/1981 | Cullen, Jr. | 404/15 |
| 4,415,615 | 11/1983 | Esmay et al. | 428/40 |
| 4,428,320 | 6/1984 | Oplt et al. | 404/14 |
| 4,490,432 | 12/1984 | Jordan | 404/14 |

OTHER PUBLICATIONS

*Encyclopedia of Polymer Science and Technology*, vol. 3, pp. 80–86 and 95–104.

*Primary Examiner*—John K. Corbin
*Assistant Examiner*—Loha Ben
*Attorney, Agent, or Firm*—Donald M. Sell; James A. Smith; Douglas B. Little

[57] ABSTRACT

A lane delineation tape is disclosed comprising a strip of cellular polymer having a reflecting layer on top and an adhesive on the bottom surface for adhering it to a road surface. Preferably it is made of elastomeric foam having a relatively low compressive strength, e.g. 100 kPa at 25% compression.

6 Claims, 2 Drawing Figures

PAVEMENT MARKING TAPE

This is a division of application Ser. No. 483,603, now U.S. Pat. No. 4,534,673 filed Apr. 11, 1983.

TECHNICAL FIELD

This invention pertains to pavement markers used in delineating traffic lanes on highways.

BACKGROUND

Historically, pavement markings have fallen into three basic classes:

(1) Painted lines having glass spheres embedded in a polymeric material to provide some degree of retroreflection;

(2) Preformed tapes comprised of polymeric film having an adhesive on one side and a layer of glass spheres on the other; and (3) Raised pavement markers providing discrete points of a retroreflective material.

Raised pavement markers offer a greater degree of night delineation or retroreflection, wet or dry, than is offered by painted lines and tapes. Most commercial forms of raised lane delineators comprise a flat-bottomed disk or base (ceramic, polymeric or metal) having a raised portion which carries a reflector portion made of reflective glass microspheres or cube-corner reflector inserts. After the passage of time, these devices can move or slide out of position under the repeated impact of vehicle wheels.

Raised markers or delineators have found wide application in road markings, but their application would be even wider except for some disadvantages, specifically: cost (more expensive than tape or reflective paint), poor durability (broken upon impact, scratched reflective surface, etc.) and placement, requiring curable adhesives (epoxy), holes or anchors to remain in place. In geographic areas in which roadways must be plowed to clear them of snow, such lane delineators are quickly removed by the plowing operation. Furthermore, raised markers made of a hard or heavy material could cause property damage and injury if they were thrown into the air by a snowplow, e.g., breaking a passing motorist's windshield.

Some known pavement markers have a raised rubber reflecting portion or tab which is intended to bend over under a vehicle tire. Others have a reflecting portion which is supposed to retract into a recess in the pavement. The former type is illustrated by U.S. Pat. Nos. 4,111,581; 3,963,362; 3,879,148; and 3,785,719. In all of these patents, the reflecting portion is a flat reflectorized rubber piece or tab rising above the pavement surface. The tab is supported at its bottom by attachment to the base portion. These designs suffer from at least two disadvantages: a. fatigue at the joint between the reflecting tab and the base (causing the tab to fail to recover to its intended position or to simply lie flat); and b. creasing or breaking of the reflector due to the flexing of the tab at some point inbetween its top and the base. The forces exerted by a moving vehicle tire on a pavement marker are complex and change as the tire traverses the marker. Vertical tab markers actually tend to crimp or bend in the middle before bending near the base. Markers having reflecting surface tabs oriented at an obtuse angle to the road surface, tend to lose reflectivity rapidlY due to the action of dirt and grit as tires pass over the reflector.

The object of this invention is a raised pavement marker offering a high degree of reflectivity, low cost, ease of placement with adequate durability, and safety while alleviating the support and creasing problems of prior raised rubber markers. Another object is to provide a preformed tape offering the same advantages of high reflectivity, low cost, and good durability.

DISCLOSURE OF INVENTION

A roadwaY marker is provided which comprises a body having a base which can be attached to a roadway, and which has a surface adapted to face oncoming traffic when the marker is mounted on a roadway, and a reflective material attached to said surface, said body being made of an elastomer and having a compressive strength (see ASTM specification D1056) at 25 percent compression of less than about 14.5 pounds per square inch (100 kPa). That is, a compressive force of less than about 100 kPa will compress the material 25%. Normally its compressive strength at 25% compression is at least 6 psi (41 kPa).

It has been found that the use of a soft, easily compressed elastomer, preferably a sponge or cellular polymer (cellular rubber), as the body of the raised marker reduces the impact forces generated when the marker is struck by a vehicle tire. A retroreflective film may be applied to the foam to provide the desired reflective properties.

Pavement markers tested in reducing this invention to practice exhibited brightness far beyond conventional paints or tapes, and similar to that of known raised pavement markers. In addition, these markers reflected effectively both wet and dry.

These markers may also utilize pressure-sensitive adhesive on the bottom for adhering to the road surface, making their placement very easy by simply pressing them to the surface.

Several other advantages are realized over known raised markers:

(1) The marker bodies can be produced in continuous extruding equipment rather than in molds or by joining various components. The polymeric body is simply extruded and cut to the desired length. The pressure-sensitive adhesive and reflective sheeting can also be applied by continuous means.

(2) No recess or hole in the roadway is required, as is the case with many other types of pavement markers.

(3) Compression of the marker body material itself is a significant contributing factor to the deformation of the marker under the vehicle wheel, in addition to bending which seems to be the major mode of deformation in known deformable or retractable pavement markers. Even solid rubber markers do not generally compress as well as cellular polymers.

Physically, all raised pavement markers (except those which retract into holes in the road) exert sufficient force to actually raise the vehicles some finite height. The greater this height becomes, the more force is exerted upon the marker by each vehicle which is forced to deviate from its path. The use of cellular elastomers minimizes this force since they compress well. The uncompressed marker height is normally in the range of 5 mm to 25 mm, and is preferably no greater than 20 mm.

Reflective tapes for such purposes as lane delineation can take advantage of the same principle. That is, they can be made of slightly raised foam or cellular polymer which easily compresses under the weight of a vehicle tire. Preferably, the total thickness of the tape is up to about 2.5 mm maximum. With ordinary tapes, much of the frictional force from a vehicle tire are believed to be transmitted to the interface between the adhesive and the road. Known tapes can smear, break or slide under these forces, e.g. the shear stress created by a tire being turned on a tape. The cellular polymer would dampen these applied forces, reducing the effect on the adhesive interface. The tape could be produced by cutting a strip of foam polymer from a cylinder of such material and applying a reflective layer to the strip. The reflective (preferably retroreflective) layer could be applied by reverse roll coating polyurethane to the foam strip and next placing glass beads on the polyurethane while it is still wet. A pressure sensitive adhesive may be placed on the bottom surface for adhereing to the road surface.

The type of raised pavement markers disclosed herein may be produced at very low cost, thereby allowing placement of a series of numerous markers so drivers would see a continuous stripe along the road. Where reflector height is 9.5 mm and viewing distance is about 61 meters the markers should be placed at about 760 mm intervals for reflecting from automobile headlights.

DETAILED DESCRIPTION OF THE INVENTION

Figure 1:
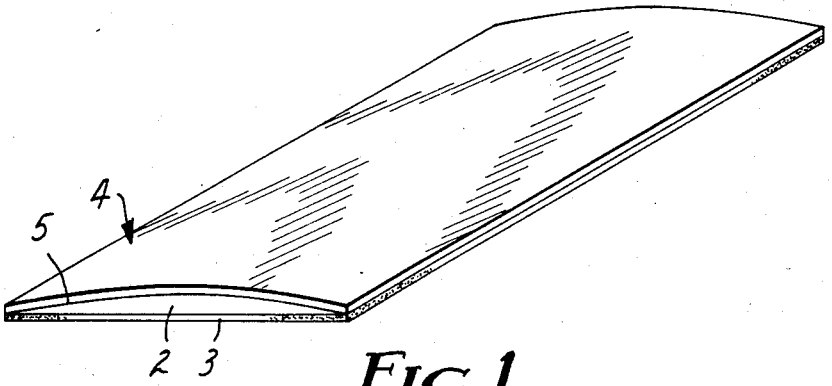
FIG. 1 is a perspective view of one embodiment of the reflective tape of this invention.
Figure 2:
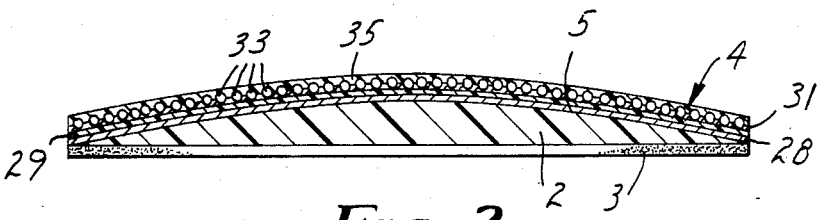
FIG. 2 is a cross-sectional view of the pavement marker of FIG. 1.

FIG. 1 shows the components of one embodiment of this invention. Item 2 is an elastomeric body, for example made of a sponge elastomer such as polyurethane, silicone rubber, ethylene propylene diene terpolymer (EPDM), neoprene or blends of EPDM and neoprene. Adhesive layer 3 is attached to the base of the body, and reflecting material 4 is attached to the top surface 5 of the body. A surprisingly small amount of adhesive is necessary to hold these flexible foam markers on the road (e.g., peel strength of 4.2 pounds per inch, 0.74 kN/m).

Reflecting portion 4 is preferably thin retroreflective sheet comprising a polymeric support sheet in which a monolayer of transparent microspheres or beads are embedded to slightly more than half their diameter. The glass beads carry a coating of reflective material such as aluminum over their embedded surfaces. The reflector support sheet has a layer of adhesive on the back by which it is adhered to the pavement marker body as shown. For wet reflection, enclosed lens sheeting appears to perform best (i.e., glass beads covered by a clear polymer layer) although an exposed lens sheeting and cube corner reflectors may also be used.

Reinforcement may be used within the body (e.g., fiberglass fabric or fibers) to strengthen the markers.

As mentioned earlier, the pavement marker bodies of this invention can be made by an extrusion process. The manufacture of cellular or sponge rubbers in an extrusion process is known. The uncured elastomer is generally compounded with vulcanizing chemicals and a blowing agent at a temperature below the decomposition temperature of the blowing agent. A suitable EPDM sponge rubber is described in Borg, E.L., "Ethylene/Propylene Rubber", in *Rubber Technology*, 2d ed., Morton, M. ed., Van Nostrand Reinhold Company, New York, 1973, at pages 242 and 243, which is incorporated herein by reference. Further description of sponge rubber is found in Otterstedt, C.W., "Closed Cell Sponge Rubber", in *The Vanderbilt Rubber Handbook*, R.T. Vanderbilt Co., Inc., Norwalk, Conn., 1978, at pages 728–729 which is also incorporated by reference herein.

The compound is extruded through a die of specified shape. The extrudate is then cured and simultaneously expanded at elevated temperature. Curing may be done in a brine bath at about 204° C.

After the body material extrudate has been cured, a reflective (preferably retroreflective) film is applied to the body surface adapted to face oncoming traffic, generally by use of an adhesive such as a pressure sensitive adhesive. The retroreflective film is preferably of the type known as wide angle flat top sheet which comprises: a back reflector 28; an overlying transparent matrix 31; a light-returning layer of small transparent spheres 33 embedded in the transparent matrix 31 in optical connection with the back reflector 28 but spaced from it so as to place the reflector 28 at the approximate focal point of the spheres thereby increasing substantially the brilliance of reflected light; and a transparent overlying solid layer 35 covering and conforming to the front extremeties of the spheres and having a flat front face. Such sheeting 4 reflects a cone of light back toward a light source, even though the incident beam strikes the reflector at an angle. One patent on the subject of such sheeting is U.S. Pat. No. 2,407,680. The transparent film 29 occupying the space between the spheres and the reflector is called the spacing film. This wide angle flat top sheeting can be considered an embedded lens or enclosed lens sheeting having a spacing film or layer with a thickness which locates the back reflector at the approximate focal point of the optical system.

Wide angle flat top retroreflective sheeting may be made, for example, by a solution casting technique comprising the following process steps: (a) providing a paper carrier web coated with a release agent such as polyethylene; (b) a coating the release agent side of the carrier web with a 25% solids solution of fully reacted aliphatic elastomeric polyurethane of the polyester type in an isopropanol, toluene, xylene solvent (e.g., QI3787 from K. J. Quinn Company in Malden, Mass.) in sufficient amount to yield about a 50 microns dry film thickness; (c) drying the coating 35 from step (b) for example at about 93° C. for 15 minutes; (d) applying a bead bond coat 31 about 5 microns thick of the same polyurethane material used in step (b) to the dry coating step (c) and contacting the wet polyurethane surface with glass microspheres 33 (e.g , about 20 microns diameter and 2.26 refractive index); (e) drying the microsphere-coated web for example at 93° C. for 5 minutes; (f) coating a spacing layer polymer 29 of the same aliphatic elastomeric polyurethane composition onto the microsphere-covered web or sheet from step (e) in sufficient amount to yield a dry film thickness about equal to the focal length of the microspheres; (g) drying the sheeting from step (f); (h) vapor coating the spacing layer with a specularly reflective material 28 (e.g., aluminum); (i) removing the paper carrier web; and (j) coating the back side of the reflective material with an acrylate-base pressure-sensitive adhesive having a silicone-coated release liner.

A polyurethane hard coating may be applied to the front surface of the sheeting to reduce the accumulation of dirt on the sheeting in use. Such a hard coating has a generally tack-free surface and substantially higher 100% modulus of elasticity and lower ultimate elongation than the polyurethane used for the transparent matrix in the reflective sheeting. A typical suitable hard coat polymer is K. J. Quinn QI3515 having a 100% modulus of 5840 psi (40.2 MPa) and 210% ultimate elongation, fully reacted aliphatic elastomeric polyurethane of the polyester type.

The polyurethane polymers used for the transparent matrix and spacing layers are useful because they are somewhat elastic and can follow the movement of the pavement marker body without delaminating.

Finally, an adhesive is applied to the bottom surface of the marker body. Preferably, it is a phenolic modified polybutadiene pressure sensitive adhesive at least about 250 microns thick cast on a disposable (paper) liner. The liner is removed prior to placement of the marker on the road surface.

The markers may be applied to the road by at least two methods. One such method is removing the adhesive liner and pressing the marker to the road surface or onto other marking materials (tape or paint). A second method comprises applying the markers to a tape which is thereafter applied to the road.

Hollow cross-section markers may help to dissipate the heat of compression better than solid foam, and they may compress better, offering less resistance to vehicles travelling over them. In the case of hollow markers, it is believed that water can become entrapped within the hollow cross-section, and the rapid, repeated compression under vehicle loading may cause rupture at any weak points.

It has been found that design of the shape of the marker contributes to an extension of durability. The shape of the marker in FIG. 1 is also easily extruded.

The reflecting portions of these markers lie flat under a vehicle tire which represents a load of at least 96 KPa. This characteristic is obtained using the sponge rubbers described previously. It can also be attained by using normal vulcanized rubbers in a hollow configuration.

Other embodiments of this invention will be apparent to those skilled in the art from a consideration of this specification or practice of the invention disclosed herein. various omissions, modifications and changes to the principles described herein may be made by one skilled in the art without departing from the true scope and spirit of the invention which is indicated by the following claims.

What is claimed is :

1. A pavement marking tape comprising a strip of cellular elastomer having a compressive strength of less than about 100 kiloPascals at 25 percent compression, said strip having a reflective layer on its top surface and an adhesive on the bottom surface for adhering it to a road surface.

2. A pavement marking tape of claim 1 in which the cellular elastomer is selected from the group consisting of polyurethane, silicone rubber, neoprene rubber, ethylene propylene, diene terpolymer (EPDM), and blends of neoprene and EPDM.

3. The pavement marking tape of claim 1 having a convex top surface.

4. The pavement marking tape of claim 1 wherein the reflective layer of the top surface comprises wide angle flat top reflective sheeting comprising: a back reflector; an overlying transparent matrix; a light-returning layer of small transparent spheres embedded in the transparent matrix in optical connection with the back reflector, but spaced from it so as to place the reflector at the approximate focal point of the spheres; and a transparent covering layer overlying the spheres.

5. The pavement marking tape of claim 4 wherein the transparent matrix of the wide angle flat top sheet is made of a polymer which is elastic.

6. The pavement marking tape of claim 1 wherein the adhesive is a pressure sensitive adhesive.

* * * * *